US007707661B2

(12) United States Patent
Issachar

(10) Patent No.: US 7,707,661 B2
(45) Date of Patent: May 4, 2010

(54) TISSUE AND TOILET SEAT-COVER SANITARY PAPER

(76) Inventor: David Issachar, 14 Vilkomitch St., Rehovot 76448 (IL)

( * ) Notice: Subject to any disclaimer, the term of this patent is extended or adjusted under 35 U.S.C. 154(b) by 286 days.

(21) Appl. No.: 11/373,189

(22) Filed: Mar. 13, 2006

(65) Prior Publication Data

US 2007/0209099 A1 Sep. 13, 2007

(51) Int. Cl.
*A47K 13/14* (2006.01)

(52) U.S. Cl. ..... 4/245.1; 4/245.8

(58) Field of Classification Search ..... 4/245.1, 4/245.5, 245.8
See application file for complete search history.

(56) References Cited

U.S. PATENT DOCUMENTS 1,125,847 A 1/1915 Humphey
1,835,787 A * 12/1931 Knisely ..... 4/245.9
1,961,195 A 6/1934 Carruthers
2,025,941 A 12/1935 Dunnell
4,050,105 A 9/1977 Marceaux
4,627,117 A 12/1986 Morishita
4,766,617 A 8/1988 Thygesen et al.
4,887,321 A 12/1989 Nelson
4,913,312 A 4/1990 Boutin
4,920,584 A 5/1990 Abdrabbo
4,998,291 A 3/1991 Marui et al.
5,107,549 A 4/1992 Pitts et al.
5,361,424 A 11/1994 Grunenfelder et al.

* cited by examiner

*Primary Examiner*—Tuan N Nguyen
(74) *Attorney, Agent, or Firm*—Mark M. Friedman

(57) ABSTRACT

The present invention discloses a sanitary paper that is designed to be appropriate for dual functions: (1) as a tissue paper for wiping and cleaning by a user, and (2) as a toilet seat-cover. The sanitary paper is a folded continuous sanitary paper strip comprising detachable sections of tissue paper, where some sections are toilet seat-covers which are defined by appropriate transverse seat-cover perforation lines. Various embodiments are described regarding the folding of the sanitary paper strip. A precut bowl flap, in each of the detachable seat-covers, is provided as well. The sanitary paper strip can be made of a single or multi-ply paper. In the preferred embodiment of the present invention, the sanitary paper is made of a duplex paper, where each surface best serves the intended function of that surface. Additionally, the sanitary paper strip can be impregnated with various chemicals.

45 Claims, 10 Drawing Sheets

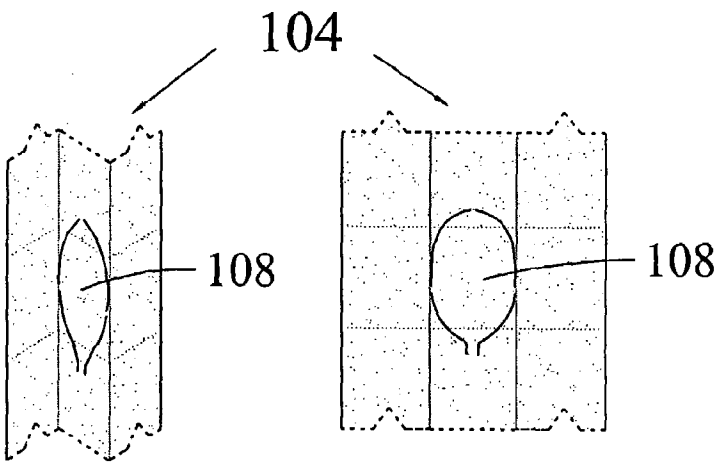
Figure 26
Figure 27
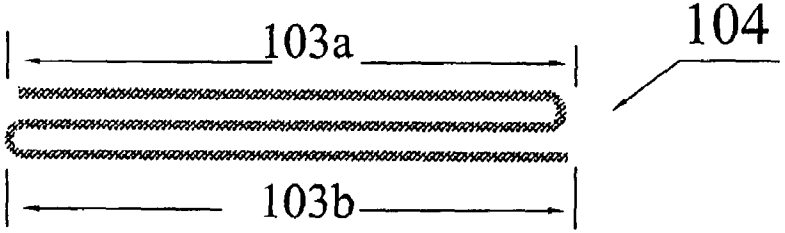
Figure 25
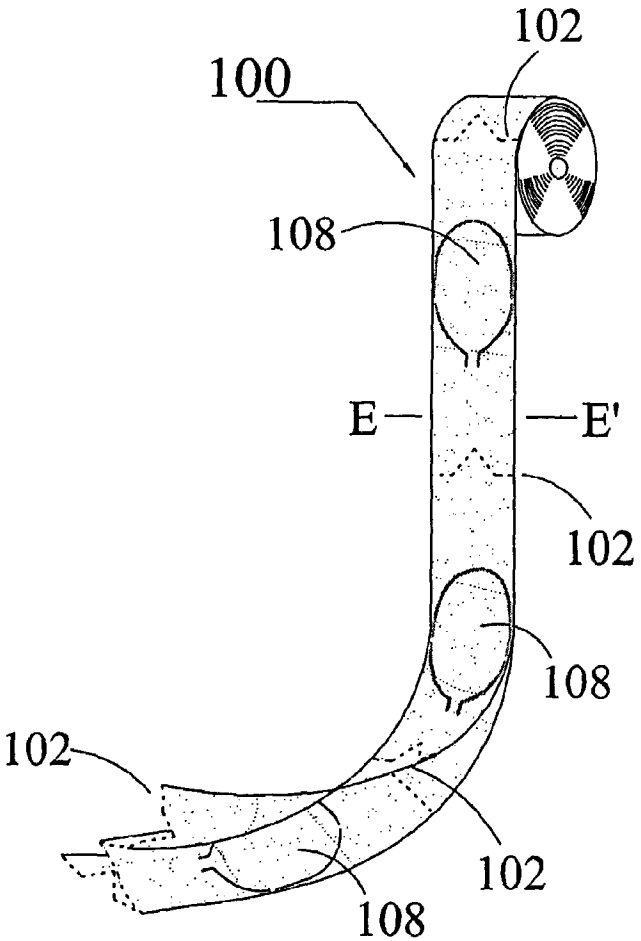
Figure 24

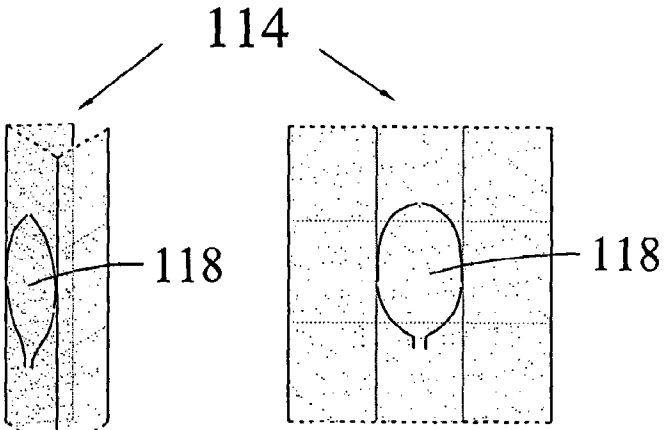
Figure 30
Figure 31
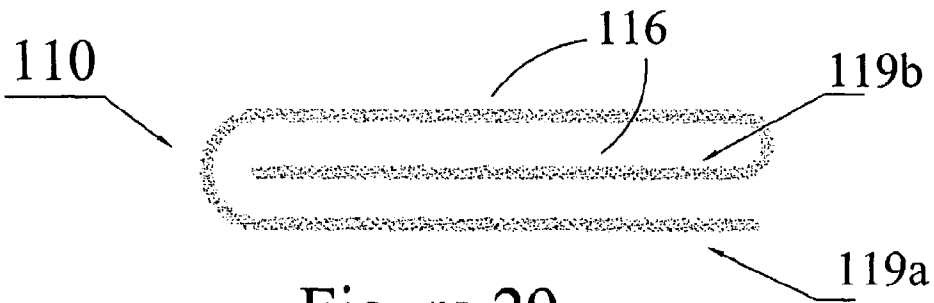
Figure 29
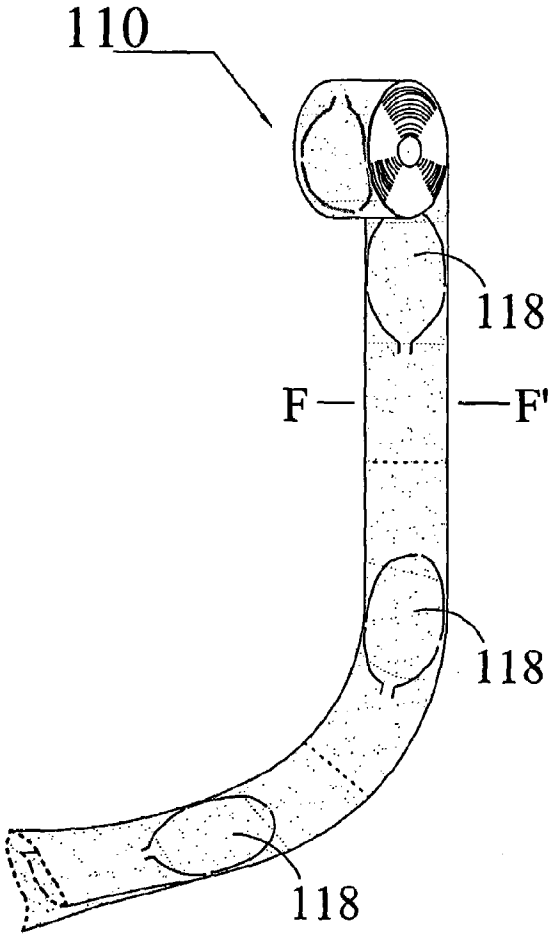
Figure 28

TISSUE AND TOILET SEAT-COVER SANITARY PAPER

FIELD AND BACKGROUND OF THE INVENTION

The present invention relates to a device for providing a sanitary paper that serves a dual function. The sanitary paper can serve as a tissue paper and as a toilet seat-cover. Among other features, this eliminates the need to maintain two types of sanitary paper in bathrooms.

Tissue paper and toilet seat-cover paper are soft, light-weight papers that are used in restrooms for personal hygiene. While the tissue paper is used for wiping the anus after defecation, the seat-cover paper is used to protect human skin from contacting the toilet seat surface. As sanitary papers which come in contact with human skin, and thus have to be disposed after use, both the tissue paper and the seat-cover paper are made of a soft, flushable, and water-soluble paper material. However, as a result of the differences in their specific tasks, they are usually differing in their paper/tissue type. Thus, for example, while tissue paper (which is designed mainly for cleaning of the anus) is usually composed of water-absorbing paper with a relatively rough surface, seat-cover paper (which is designed to protect human skin from contacting the toilet seat surface) is usually composed of a soft, smooth (glazed) paper, sometimes impregnated with chemicals (such as antibacterial compounds).

Today, as a result of the differences in their tasks and their material composition, tissue paper and seat-cover paper are usually packaged in a completely different configuration, and supplied to the customer as separate units. Thus, for example, while tissue paper is formed and supplied as a continuous strip packaged in a roll with a plurality of transverse perforations at regular intervals, seat-cover paper is usually supplied as separate sheets, packaged in a box-shaped dispenser.

Various types and configurations of tissue paper and seat-cover paper have been described in the prior art. Thus, for example, U.S. Pat. Nos. 2,025,941, 4,050,105 and 4,766,617 disclose disposable and flushable toilet seat-covers packaged as individual units, while U.S. Pat. No. 4,998,297 discloses reusable toilet seat-covers, packaged as individual units. U.S. Pat. No. 4,920,584 disclose a long sleeve of non-porous and non-biodegradable material that contains many non-disposable seat covers, while U.S. Pat. No. 5,107,549 discloses a disposable and flushable sleeve-shaped cover seat that is detachable from a continuous sheet packaged in a roll.

Another type of disposable seat cover that is packaged in a roll is disclosed in U.S. Pat. No. 4,627,117 and Japanese Patent 2000139774. In all cases of the prior art, the tissue paper and the seat-cover paper appear as separate units or in some type of package combination, such as those manufactured by Tubular Specialties Mfg. (TSM) located in California USA, and American Specialties Inc, (ASI) located in New-York USA.

Although it is of great importance to have seat-cover paper also in small public places such as restaurants, the present situation is far from that, even in private homes. This is counter to the fact that many people are reluctant to have contact with a toilet seat outside their own homes. A recent study shows that more than 90% of women would not sit directly on a toilet seat. Presently, it can be seen that, while use of tissue paper is widespread and it can be found in almost every home, seat-cover paper is found only in selected public places like hospitals, airports, and hotels.

Some of the reasons that hamper the wide commercial distribution of toilet seat-covers are: (1) the cost to manufacture such units, and (2) the relatively large and bulky dispensers, that are usually required for packaging and storage of the individually-folded, seat-cover sheets. Such bulky dispensers, in turn, necessitate the allocation of significant wall space to accommodate them. For these reasons, private citizens and owners of small public places (like restaurants) prefer not to buy the commercial, bulky, and expensive seat covers. Instead, they prefer to cut pieces of tissue paper (which they usually have a plentiful supply of), and prepare "hand-made" seat covers on the spot. Namely, they cut pieces of tissue paper, and arrange them around the rim of the toilet seat in such way that it will keep their skin from direct contact with the toilet seat.

Therefore, in order for such sanitary seat-cover paper to become attractive to private customers and small businesses also, it is of great importance to have a relatively inexpensive sanitary paper that can be used easily and conveniently as tissue paper, or alternatively, as a toilet seat-cover.

SUMMARY OF THE INVENTION

It is therefore the objective of the present invention to disclose a disposable sanitary paper that is designed to be used as a dual-function paper. The paper is intended to serve as a source for detachable sections of tissue paper, as well as a source for detachable toilet seat-covers.

It is further the objective of the present invention to disclose a sanitary paper that, in a very simple and convenient way, can be switched from a conventional tissue paper to a conventional toilet seat-cover.

It is further the objective of the present invention to disclose a sanitary paper that can be quickly and easily unfolded to form an unfolded seat-cover.

It is still further the objective of the present invention to disclose a dual-function sanitary paper with a configuration and size that are similar to commercially-manufactured tissue paper found in almost every bathroom. In other words, a sanitary paper of the present invention, when packaged in a roll configuration, can be located in the same place and in the same tissue-paper roll holder where conventional tissue paper is located.

It is still further the objective of the present invention to disclose a compact dual-function sanitary paper as a source for sections of tissue paper, and as a source for toilet seat-covers, that can be packed in a "pop-up"-like package.

It is still further the objective of the present invention to disclose a dual-function sanitary paper of very compact size that can be conveniently and discretely carried in one's purse, coat pocket, or automobile glove compartment.

It is still further the objective of the present invention to disclose a dual-function sanitary paper that is significantly more economical than the combination of commercial tissue paper and commercial toilet seat-covers.

When the folded sanitary paper is made of a thin rough material, similar to most manufactured tissue paper, the folded layers tend to adhere to each other which makes their grasp and separation extremely difficult. This difficulty is significantly reduced when one side of the paper is smooth and glazed. In such a case, the smooth surface not only increases the strength of the paper, but also minimizes the adherence of the folded layers to each other. This facilitates the unfolding of a detached seat-cover by a user. Consequently, when the folded sanitary paper strip is made of a duplex paper, where the smooth surfaces have a lower tendency to adhere to each other, the unfolding of the detached seat-cover is simpler and easier.

For the purpose of clarity, several terms which follow are specifically defined for use within the context of this application. The term "duplex paper" is used to refer to any paper that is composed of one or more plies, where one of its external surfaces is smooth or glazy, while the other surface is rough. The term "tissue paper" is used to refer to a general-purpose paper suitable to be used as toilet paper, but can also be used, for example, to wipe one's face, blow one's nose, or clean an object. The terms "curved" and "non-linear" are used to refer to lines that can be (a) arcs (or combinations of arcs) of a radius, (b) combinations of straight lines, or (c) combinations of (a) and (b). The term "non-self-adherent" is used to refer to surfaces that do not tend to adhere strongly to surfaces of the same material. That is, surfaces which may initially be touching each other, but are separated from each other with minimal effort and no damage to the surface.

It should be noted that it is common practice to manufacture tissue paper with multiple plies. Therefore, when the sanitary paper material, from which the sanitary paper strip is made, is a multi-ply paper, then each of the layers in the folded strip can be a multi-ply layer.

With regard to packaging; according to the preferred embodiment of the present invention, the folded sanitary paper strip is rolled longitudinally on a roll axis of a conventional bathroom tissue dispenser. The folded sanitary paper strip has an overall width similar to the width of conventional rolled tissue paper (about 10 to 12 cm). Thus, no additional dispensing device is required.

A sanitary paper that is designed and configured according to the present invention has unique features that are advantageous to the prior art devices. These features include: (a) a dual-function paper that serves as a conventional tissue paper for cleaning and as a source for toilet seat-covers, (b) a compact paper suitable for use with indoor and outdoor toilets, (c) a replacement item for conventional tissue paper that requires no special dispensing device (since the dimension of the disclosed sanitary paper is similar to that of conventional rolled tissue paper), (d) a rolled dual-function sanitary paper that can replace conventional tissue paper in the same location and in the same roll dispensing device where conventional tissue paper is located, (e) a seat-cover that is easily unfolded when detached from the sanitary paper strip, and (f) a relatively economical alternative to conventional practice when compared to maintaining separate units of tissue paper and toilet seat-covers.

Therefore, according to the present invention, there is provided for the first time a device that is appropriate to be used as tissue paper and as toilet seat-covers, the device including: (a) a sanitary paper strip for cleaning by a user and covering a toilet seat, the sanitary paper strip having a plurality of detachable sections of tissue paper, where at least some of the detachable sections are folded toilet seat-covers, the sanitary paper strip folded to produce at least three layers; and (b) a plurality of transverse perforation lines that define the plurality of detachable sections of tissue paper, at least some of the plurality of transverse perforation lines are seat-cover perforation lines, the seat cover perforation lines define a beginning and an end of an individual seat-cover.

Preferably, the individual seat-cover, when fully-unfolded and applied appropriately on the toilet seat, has a configuration and size sufficient to cover the toilet seat, such that the individual seat-cover prevents direct contact between the toilet seat and the skin of the user.

Preferably, each of the individual seat-cover has a precut centrally-located bowl flap.

Preferably, each of the individual seat-cover has a centrally-located bowl cutout, the bowl cutout of the individual seat-cover is smaller than the opening of the toilet seat.

Preferably, the detachable sections of tissue paper serve at least two functions, appropriate for cleaning by the user, and appropriate for covering the toilet seat when fully-unfolded.

Preferably, the detachable sections of tissue paper are appropriate for wiping the anus of the user.

Preferably, at least some of the seat-cover perforation lines are straight.

Preferably, at least some of the seat-cover perforation lines are non-linear.

Preferably, at least some of the seat-cover perforation lines are oriented in each the at least three layers of the sanitary paper strip to form at least one non-overlapping handle member upon detaching the individual seat-cover, the at least one non-overlapping handle member for facilitating unfolding of the individual seat-cover by the user.

Preferably, at least one of the at least three layers has a width that forms a non-overlapping adjacent layer, the non-overlapping adjacent layer for facilitating unfolding of the individual seat-cover by the user.

Preferably, the individual seat-cover has at least one niche located at an exposed outer layer of the at least three layers, the at least one niche exposing a part of an adjacent layer of the at least three layers to the exposed outer layer, the at least one niche having a location and size for facilitating unfolding of the individual seat-cover by the user holding the exposed part of the adjacent layer.

Preferably, the sanitary paper strip is made of a soft, disposable, flushable, and highly-absorbent material.

Preferably, the sanitary paper strip has at least one non-self-adherent surface.

Preferably, the sanitary paper strip is wrapped in a substantially roll configuration.

Preferably, the sanitary paper strip is stack-folded in a pop-up dispenser.

Preferably, the sanitary paper strip is stack-folded in a box.

Preferably, the sanitary paper strip is made of a duplex paper, the duplex paper having a smooth surface and a rough surface, the rough surface is suitable to be used as a tissue paper.

Preferably, the sanitary paper strip is impregnated with a chemical on at least one surface.

Preferably, the sanitary paper strip is composed of a plurality of plies, at least one layer of the at least three layers is composed of the plurality of plies.

Preferably, the sanitary paper strip is folded to produce three layers, two laterally-folded longitudinal layers of the three layers are lapped on top of each other, and are vertically-adjacent when the sanitary paper strip is fully-folded, and the centrally-located bowl flap is located in an external layer of the three layers.

Most preferably, at least a part of the centrally-located bowl flap of the individual seat-cover of the sanitary paper strip is located in an inner layer of the at least three layers when folded.

Most preferably, at least a part of the centrally-located bowl flap of the individual seat-cover of the sanitary paper strip is not exposed to direct contact with the user.

Most preferably, the sanitary paper strip is folded to produce three consecutively-stacked layers with a cross-sectional outline resembling an English letter "Z" when the sanitary paper strip is partially-unfolded.

Most preferably, the sanitary paper strip is folded to produce four layers with a cross-sectional outline resembling an English letter "W" when the sanitary paper strip is partially-unfolded, and the centrally-located bowl flap is located in two inner layers of the four layers.

Most preferably, the sanitary paper strip is folded to produce four layers with two laterally-folded longitudinal layers of the sanitary paper strip adjacent to each other and located on one side of the sanitary paper strip.

Most preferably, the bowl cutout of the individual seat-cover has at least one rim flap, the at least one rim flap for facilitating proper positioning of the individual seat-cover on the toilet seat.

Most preferably, the sanitary paper strip is rolled such that the centrally-located bowl flap of the sanitary paper strip is located on an unexposed surface of the substantially roll configuration.

Most preferably, the sanitary paper strip is folded such that the rough surface of the sanitary paper strip is an exposed surface.

Most preferably, the chemical includes at least one chemical selected from the group consisting of: a detergent, a deodorant, an anti-bacterial agent, an anti-viral agent, or an anti-fungal agent.

These and other objectives and advantages of the present invention will become more apparent from the following description when taken in conjunction with the accompanying drawings.

BRIEF DESCRIPTION OF THE DRAWINGS

The invention is described herein, by way of example only, with reference to the accompanying drawings, wherein:

FIG. 24 is perspective view of an alternate sanitary paper strip, folded in a configuration that resembles the English letter "Z", which enables a sanitary paper strip to be folded in three layers, according to some embodiments of the present invention;

FIG. 25 is a cross-sectional view of a folded, sanitary paper strip, according to some embodiments of the present invention, taken along the E-E' line shown in FIG. 24;

FIG. 26 is a perspective view of a partially-unfolded seat-cover detached from a sanitary paper strip, shown in FIG. 24, according to some embodiments of the present invention;

FIG. 27 is a plan view of a seat-cover, shown in FIG. 26, fully-unfolded, according to some embodiments of the present invention;

FIG. 28 is a perspective view of an alternate sanitary paper strip folded in three layers, according to some embodiments of the present invention;

FIG. 29 is a cross-sectional view of a folded, sanitary paper strip, according to some embodiments of the present invention, taken along the F-F' line shown in FIG. 28;

FIG. 30 is a perspective view of a partially-unfolded seat-cover detached from a sanitary paper strip, shown in FIG. 28, according to some embodiments of the present invention;

FIG. 31 is a plan view of a seat-cover, shown in FIG. 30, fully-unfolded, according to some embodiments of the present invention;

DESCRIPTION OF THE PREFERRED EMBODIMENTS

Figure 1:
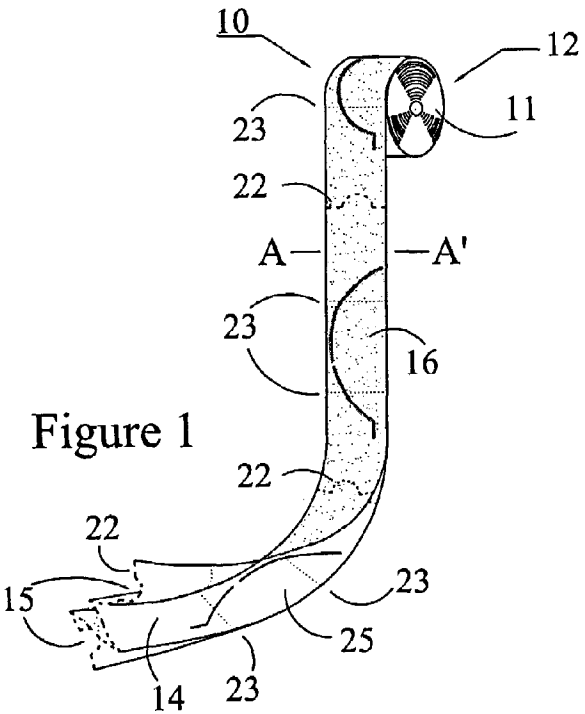
FIG. 1 is a perspective view of a folded, sanitary paper strip, according to some embodiments of the present invention, wrapped substantially in a roll configuration.

The present invention is a sanitary paper that is specially-designed to be suitable for dual applications: (1) as a source for sections of tissue paper for wiping and cleaning, and (2) as a source for toilet seat-covers. The principles and operation of a sanitary paper according to the present invention may be better understood with reference to the drawings and the accompanying description.

Referring now to the drawings, one of the preferred embodiments, according to the present invention, of a sanitary paper strip 10 is shown in FIGS. 1 through 10. According to this embodiment, the sanitary paper strip 10 is a folded, continuous paper that is rolled longitudinally on a roll axis 11 of a conventional, bathroom, tissue roll dispenser, whereby a sanitary roll 12 (i.e. sanitary paper strip 10 when rolled) has an overall width which is similar to the width of conventional, rolled tissue paper (about 10 to 12 cm). Sanitary paper strip 10 is made of any suitable length, dependent upon the amount of paper to be provided in the roll.

According to some preferred embodiments, sanitary paper strip 10 is made of a laminated duplex paper, where a seat-cover side 14 is a smooth (glazed) surface, while a tissue-paper side 16 is a relatively rough surface, making up the two sides of the paper. This type of laminated duplex paper not only provides softness to a user but also affords enhanced strength to the paper. For this application, we use the term "duplex paper" to refer to any paper having seat-cover side 14 and tissue-paper side 16.

Figure 3:
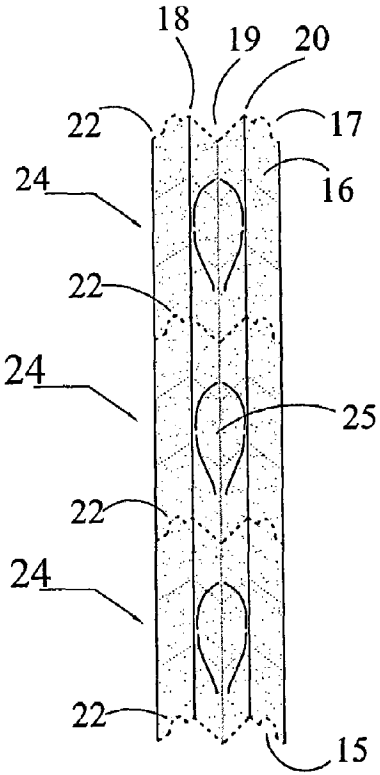
FIG. 3 is a perspective view of a partially-unfolded section of a sanitary paper strip, shown in FIG. 1, showing the rough surface of three consecutive, detachable seat-cover sheets of the paper strip, according to some embodiments of the present invention.
Figure 2:
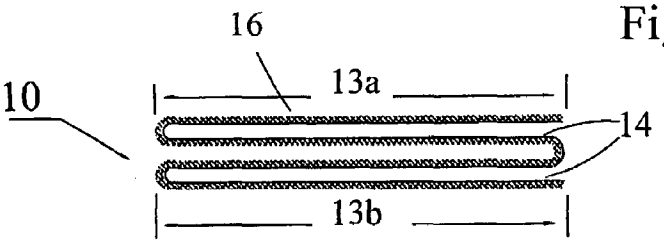
FIG. 2 is a cross-sectional view of a folded, sanitary paper strip, according to some embodiments of the present invention, taken along the A-A' line shown in FIG. 1.

The folding configuration of sanitary paper strip 10 can be better understood from FIG. 2, which is a magnified cross-section taken along the A-A' line of FIG. 1. As shown in FIG. 2, sanitary paper strip 10 is folded in such way that it produces four layers that resembles a four-ply tissue paper. The width of each layer, and consequently the width of sanitary roll 12 (FIG. 1), is approximately one-fourth of sanitary paper strip 10 when fully-flattened. The folding of sanitary paper strip 10 is such that when sanitary paper strip 10 is partially-unfolded, as shown in FIG. 3. The cross-sectional view of sanitary paper strip 10 resembles the configuration of the English letter "W". In such a folded configuration, bowl precuts 25 are located in the two inner layers (shown in FIG. 2), while longitudinal layers 13*a* and 13*b* enwrap the inner layers from the outside, with tissue-paper side 16 facing outward and seat-cover side 14 facing inward. It should be pointed out that folding sanitary paper strip 10 in such a way, where surfaces of tissue-paper side 16 are facing outward, is important for using sanitary paper strip 10 as tissue paper.

It should be noted that it is common practice to manufacture tissue paper with multiple plies. Therefore, for example, included in our definition of duplex paper, in the "W" configuration described above, are a two-ply duplex paper in which each layer is a two-ply layer, a three-ply duplex paper in which each layer is a three-ply layer, and other similar configurations.

Figure 4:
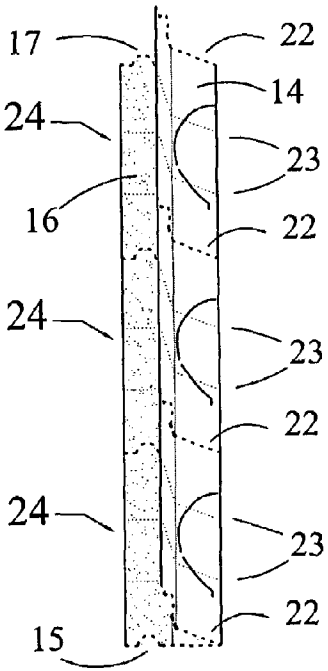
FIG. 4 is a perspective view of a partially-unfolded section of a sanitary paper strip, shown in FIG. 1, showing the rough and the smooth surfaces of three consecutive, detachable seat-cover sheets of the paper strip, according to some embodiments of the present invention.

Some features of sanitary paper strip 10 are better understood with reference to FIGS. 3 through 10. The partially-unfolded section of sanitary paper strip 10 is shown in FIGS. 3 and 4. Sanitary paper strip 10 is folded along longitudinal lines 18, 19, and 20. Sanitary paper strip 10 is divided by two types of transverse perforation lines. Seat-cover perforation lines 22, which define the ends of an individual detachable seat-cover 24, are curved and not straight lines. Tissue-paper perforation lines 23 are straight lines and function similarly to perforation lines that are present in conventional, commercial tissue paper. As shown in FIGS. 3 and 4, seat-cover perforation lines 22 are curved, where the shape of each of curve is a combination of a straight line and semi-circular lines located at the outer layers of sanitary paper strip 10. As will be shown more clearly later, the purpose of the curved configuration of seat-cover perforation lines 22 is to facilitate the unfolding of a detached seat cover from sanitary paper strip 10.

Figure 7B:
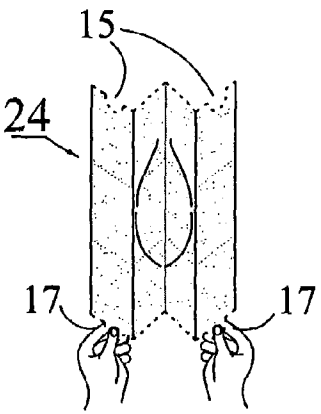
FIG. 7B is a perspective view of a detached seat-cover, shown in FIG. 6B, partially-unfolded, according to some embodiments of the present invention.
Figure 7A:
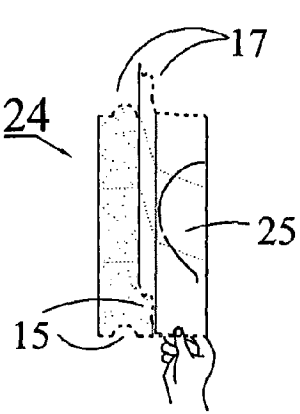
FIG. 7A is a perspective view of a detached seat-cover, shown in FIG. 6A, partially-unfolded, according to some embodiments of the present invention.
Figure 5:
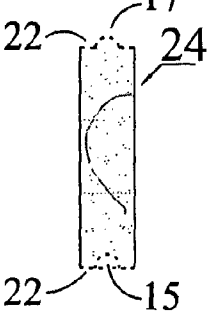
FIG. 5 is a plan view of an individual seat-cover detached from a sanitary paper strip shown in FIG. 1.

FIG. 5 is a plan view of a seat cover that was detached from sanitary paper strip 10 shown in FIG. 1. As shown in FIG. 5, seat-cover 24 that is detached from sanitary paper strip 10 along seat-cover perforation lines 22 has a niche 15 and a handle member 17 for easily unfolding seat-cover 24. FIG. 6A is a perspective view of an individual seat-cover 24, showing a way that a user can hold detached seat-cover 24 during unfolding. A user holds detached seat cover 24 at the exposed area of the inner layers (that were exposed by the perforation cuts of niche 15), and shakes folded seat-cover 24, causing it to unfold, as shown in FIG. 7A.

Figure 6B:
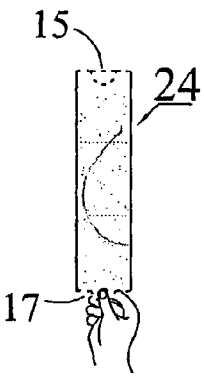
FIG. 6B is a perspective view of an individual seat-cover, shown in FIG. 5, showing an alternate way that a user can hold the detached seat-cover during unfolding, according to some embodiments of the present invention.
Figure 6A:
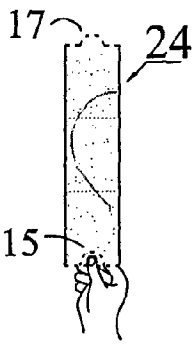
FIG. 6A is a perspective view of an individual seat-cover, shown in FIG. 5, showing a way that a user can hold the detached seat-cover during unfolding, according to some embodiments of the present invention.

FIG. 6B is a perspective view of an individual seat-cover 24, showing an alternate way that a user can hold detached seat-cover 24, during unfolding, by grasping two handle members 17 (i.e. one from each side of individual seat-cover 24). A user uses handle members 17 to unfold seat-cover 24, shown in FIG. 7B. It should be noted that as a result of the detachment of seat-cover 24 along seat-cover perforation lines 22, handle members 17, located at the two outer layers of folded seat-cover 24, are already separated from each other. This allows a user to hold each of handle members 17 in order to unfold seat-cover 24.

Figure 10:
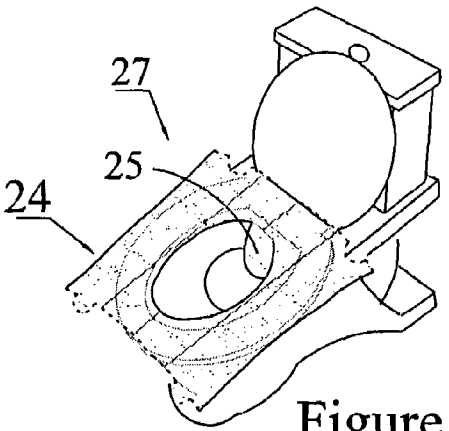
FIG. 10 is a perspective view of a fully-unfolded seat-cover, shown in FIG. 9, placed on a toilet seat, according to some embodiments of the present invention.
Figure 9:
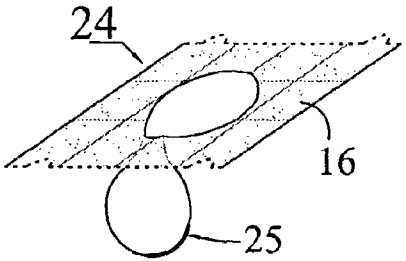
FIG. 9 is a perspective view of a fully-unfolded seat-cover, shown in FIG. 8, after the precut bowl flap has been released, according to some embodiments of the present invention.
Figure 8:
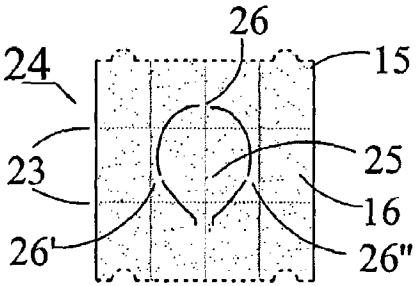
FIG. 8 is a plan view of a fully-unfolded seat-cover, shown in FIGS. 7A and 7B, according to some embodiments of the present invention.

As shown from FIGS. 8 through 10, the seat-cover 24 is quite similar to conventional toilet seat-covers that are manufactured today. At the central part of each detachable seat-cover 24 of sanitary paper strip 10, there is a precut bowl flap 25 secured by releasable integrated connections 26, 26', and 26" (FIG. 8). Connections 26, 26', and 26" have to be severed in order to form an opening at the center of seat-cover 24 (FIG. 9) before applying seat-cover 24 to a toilet seat 27 (FIG. 10). In addition, the size of each seat-cover 24, when fully-unfolded, is enough to cover toilet seat 27 in such way that prevents direct contact between toilet seat 27 and the skin of the user seated on toilet seat 27 (FIG. 10).

During use, sanitary paper strip 10 is torn off at a selected transverse perforation line according to the specific application needed. For wiping and cleaning a user, sanitary paper strip 10 is unrolled from roll 12 and torn off at any of transverse perforation lines 22 or 23, according to the paper length desired by a user. When a seat-cover is needed, sanitary paper strip 10 is unrolled from roll 12 and torn at two, consecutive, seat-cover perforation lines 22. By doing so, a complete unit of folded seat-cover 24 is detached from sanitary paper strip 10. Following this procedure, unfolding of detached seat-cover 24 can be assisted by using members 15 or 17 (or both), as has been described above, shown in FIGS. 5 through 7. After connections 26, 26' and 26" are severed (FIG. 8), bowl flap 25 has been released as shown in FIG. 9. Fully-unfolded seat-cover 24 is placed on the toilet seat 27 while bowl flap 25 hangs down into the bowl, as shown in FIG. 10. In addition, bowl flap 25 aids in drawing seat-cover 24 down the drain when the toilet is flushed.

Figure 12:
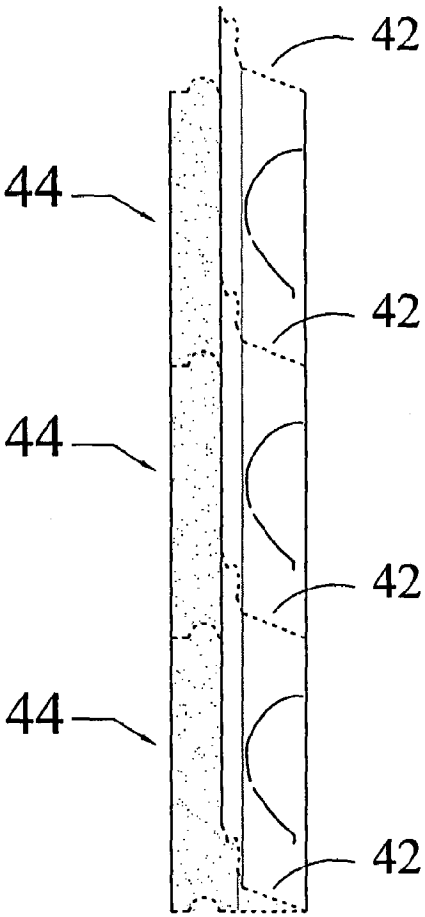
FIG. 12 is a perspective view of a partially-unfolded section of a sanitary paper strip, shown in FIG. 11, showing three consecutive, detachable seat-covers of a sanitary paper strip, according to some embodiments of the present invention.
Figure 11:
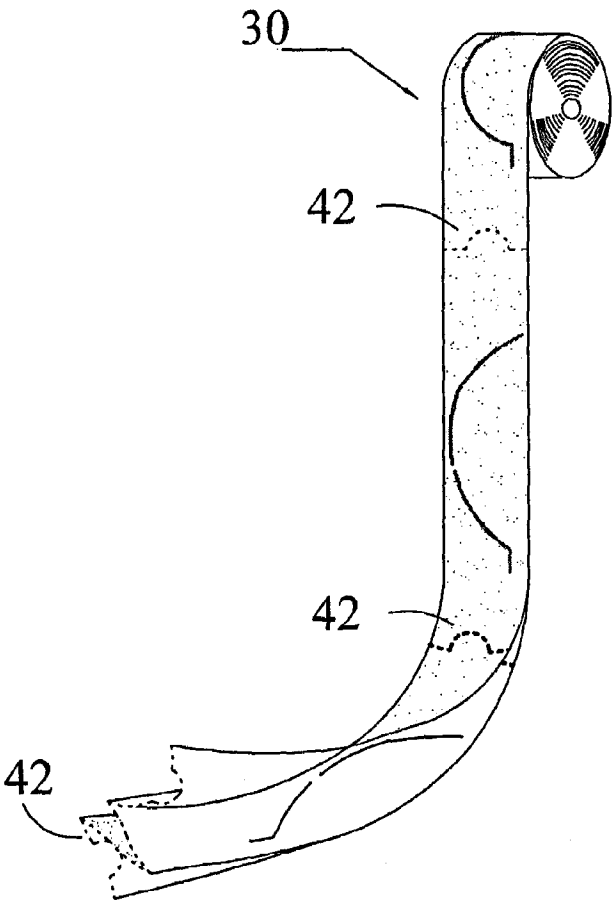
FIG. 11 is a perspective view of an alternate sanitary paper strip, according to some embodiments of the present invention, with perforation lines only for the individual, detachable seat-covers.

FIGS. 11 and 12 show another embodiment of a sanitary paper strip, similar to the embodiment shown in FIGS. 1 through 10. As with sanitary paper strip 10 of FIG. 1, a sanitary paper strip 30, shown in FIG. 11, has curved seat-cover perforation lines 42 that facilitate the unfolding of a detached seat-cover 44 (FIG. 12) from sanitary paper strip 30. The main difference between sanitary paper strip 10 of FIG. 1 and sanitary paper strip 30 of FIG. 11 is that in contrast to sanitary paper strip 10, sanitary paper strip 30 contains only transverse seat-cover perforation lines 42 that define the beginning and the end of each detachable seat-cover 44. A partially-unfolded section of sanitary paper strip 30, with three consecutive detachable seat-covers 44, is shown in FIG. 12. The description and use of sanitary paper strip 30 is otherwise similar to sanitary paper strip 10 detailed above.

Figure 14:
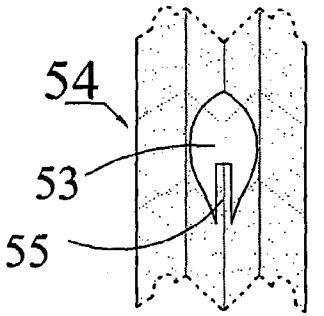
FIG. 14 is a perspective view of a partially-unfolded seat-cover detached from a sanitary paper strip, shown in FIG. 13, according to some embodiments of the present invention.
Figure 15:
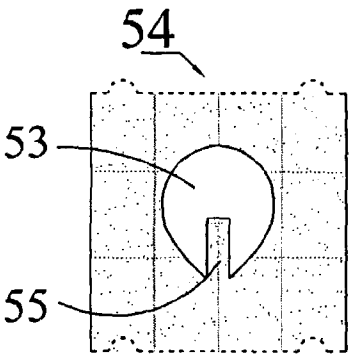
FIG. 15 is a plan view of a fully-unfolded seat-cover from a sanitary paper strip, shown in FIG. 13, according to some embodiments of the present invention.
Figure 16:
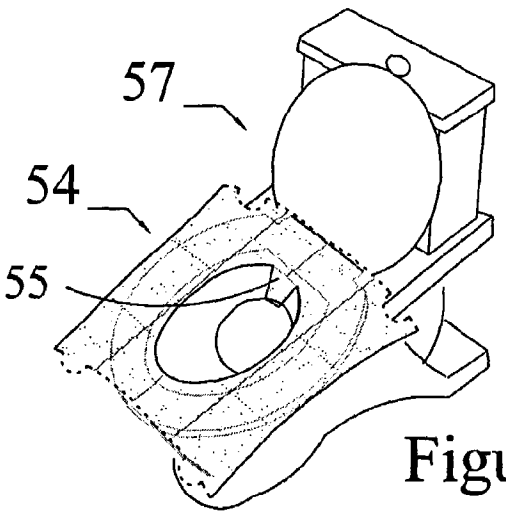
FIG. 16 is a perspective view of a fully-unfolded seat-cover, shown in FIG. 15, placed on a toilet seat, according to some embodiments of the present invention.
Figure 13:
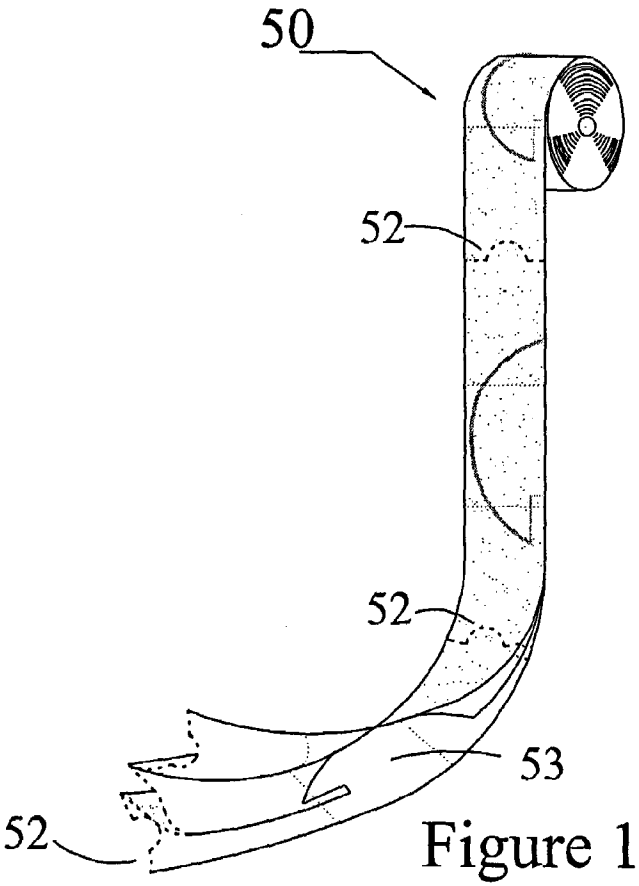
FIG. 13 is a perspective view of an alternate sanitary paper strip detachable seat-cover prior to unfolding, according to some embodiments of the present invention, with a centrally-located bowl cutout in each detachable seat-cover.

FIGS. 13 through 16 show another embodiment of a sanitary paper strip according to the present invention, similar to the embodiment shown in FIGS. 1 through 10. As with sanitary paper strip 10 of FIG. 1, a sanitary paper strip 50, shown in FIG. 13, contains curved perforation lines 52 that define the beginning and the end of each detachable seat-cover 54 (FIG. 14). The main difference between sanitary paper strip 50 and other sanitary paper strips shown in FIGS. 1 through 12 is related to the central part of seat-cover 54. As shown in FIGS. 13 through 15; seat-cover 54 of sanitary paper strip 50 has a centrally-located bowl cutout 53. This is in contrast to the seat-covers of the embodiments described above which have precut bowl flap 25, shown in FIGS. 8 through 10. As shown in FIG. 15, detached seat-cover 54 has a small rim flap 55. The purpose of rim flap 55 is to keep seat-cover 54 from sliding out of the rim of a toilet seat 57 (FIG. 16). The description and use of sanitary paper strip 50 is otherwise similar to sanitary paper strip 10 detailed above.

Figure 18:
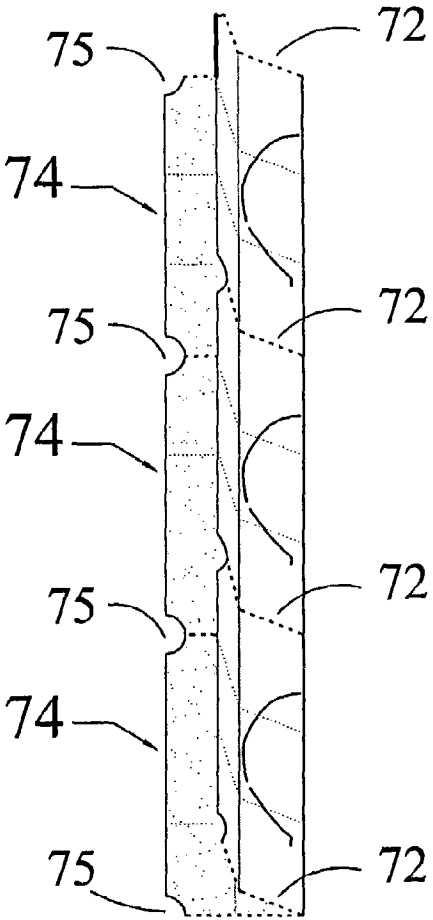
FIG. 18 is a perspective view of a partially-unfolded section of a sanitary paper strip, shown in FIG. 17, showing three consecutive, detachable seat-covers of a sanitary paper strip, according to some embodiments of the present invention.
Figure 17:
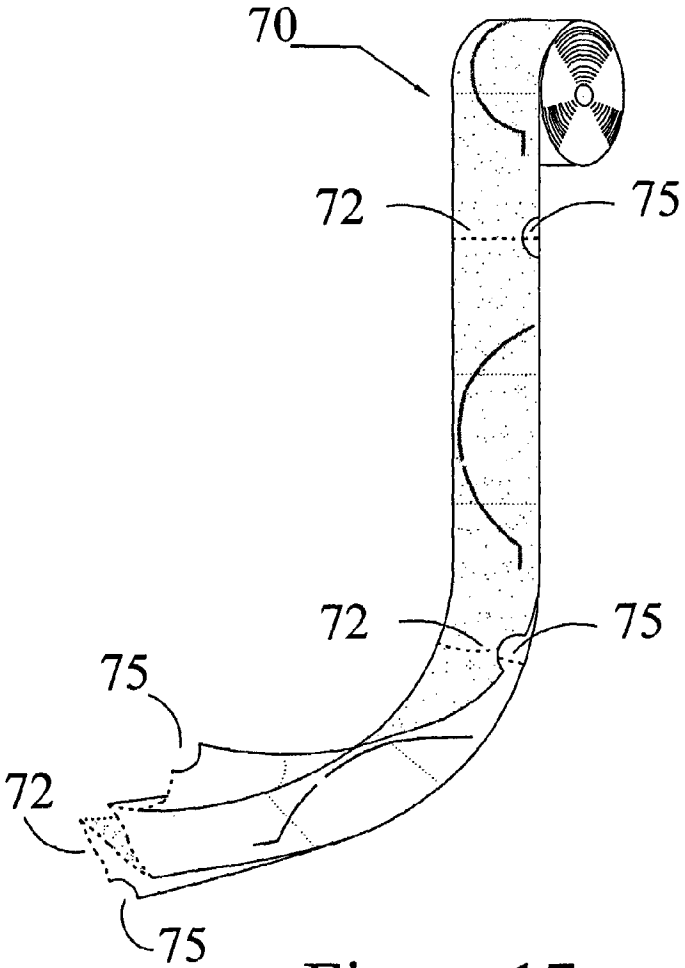
FIG. 17 is a perspective view of an alternate sanitary paper strip, according to some embodiments of the present invention.

FIGS. 17 and 18 show another embodiment of a sanitary paper strip according to the present invention, similar to the embodiment shown in FIGS. 1 through 10. The main difference between sanitary paper strip 10 of FIG. 1 and a sanitary paper strip 70 of FIG. 17 is related to the perforation lines that define the beginning and the end of each detachable seat-cover 74. As shown in FIG. 17, seat-cover perforation lines 72 of sanitary paper strip 70 are straight lines, in contrast to seat-cover perforation lines 22 of sanitary paper strip 10 of FIG. 1 which are curved. In the present embodiment shown in FIGS. 17 and 18, a detachable seat-cover 74 has niche 75 cut into seat-cover 74 which expose the inner layers at that region for facilitating the unfolding of detachable seat-cover 74 from sanitary paper strip 70. Detached seat-cover 74 is unfolded by grasping the inner layers of seat-cover 74 at the exposed area of niche 75, and shaking seat-cover 74. The description and use of sanitary paper strip 70 is otherwise similar to sanitary paper strip 10 detailed above.

Figure 20:
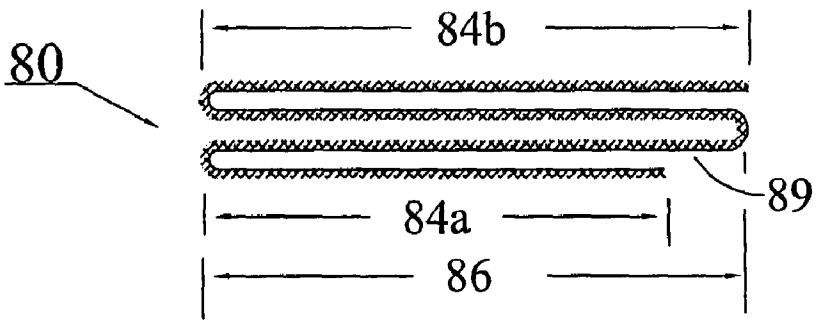
FIG. 20 is a cross-sectional view of a folded, sanitary paper strip, according to some embodiments of the present invention, taken along the C-C' line shown in FIG. 19.
Figure 19:
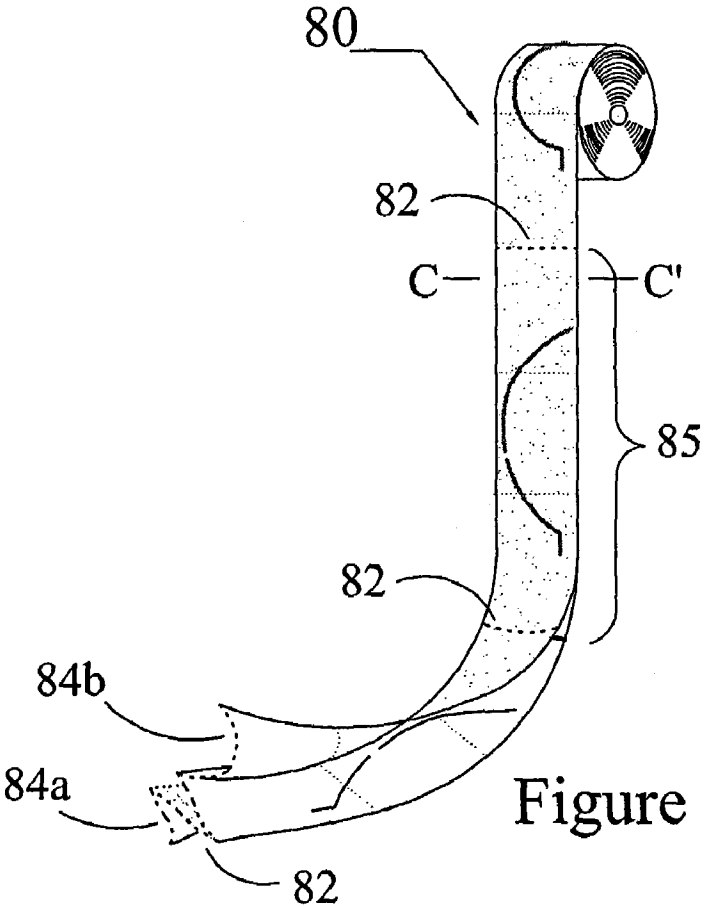
FIG. 19 is a perspective view of a folded, alternate sanitary paper strip, according to some embodiments of the present invention, with the width of one of the two laterally-folded, longitudinal layers of the sanitary paper strip narrower than the other.

FIG. 19 shows another embodiment of a sanitary paper strip according to the present invention, similar to the embodiment of sanitary paper strip 70 shown in FIG. 17. The main difference between sanitary paper strip 70 of FIG. 17 and a sanitary paper strip 80 of FIG. 19 is related to the difference in width of one of the laterally-folded, longitudinal layers of the sanitary paper strip. Sanitary paper strip 80, shown in FIG. 19, has the width of one of the two laterally-folded, longitudinal layers 84*a* and 84*b* of sanitary paper strip 80 narrower than the other. FIG. 20 is a cross-sectional view of sanitary paper strip 80 taken along the C-C' line of FIG. 19. As shown in FIG. 20, longitudinal layer 84*a* does not overlap with the adjacent longitudinal layer 86, but it is significantly narrower. This type of folding of sanitary paper strip 80 facilitates the unfolding of a seat-cover 85 detached from sanitary paper strip 80. In order to unfold seat-cover 85 detached from sanitary paper strip 80, a user has to grasp seat-cover 85 at the non-overlapping part of sanitary paper strip 80, which is at longitudinal layer 89 shown in FIG. 20. With a simple flip or movement of the hand, the longitudinal folds of seat-cover 85 will readily shake out so that seat-cover 85 is fully-unfolded. The description and use of sanitary paper strip 80 is otherwise similar to sanitary paper strip 10 detailed above.

Figure 22:
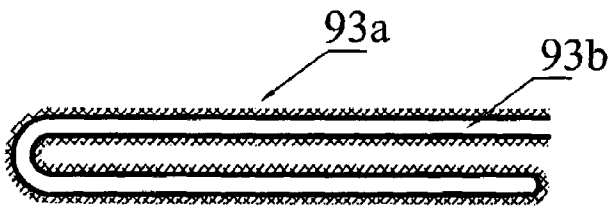
FIG. 22 is a cross-sectional view of a folded, sanitary paper strip, according to some embodiments of the present invention, taken along the D-D' line shown in FIG. 21.
Figure 21:
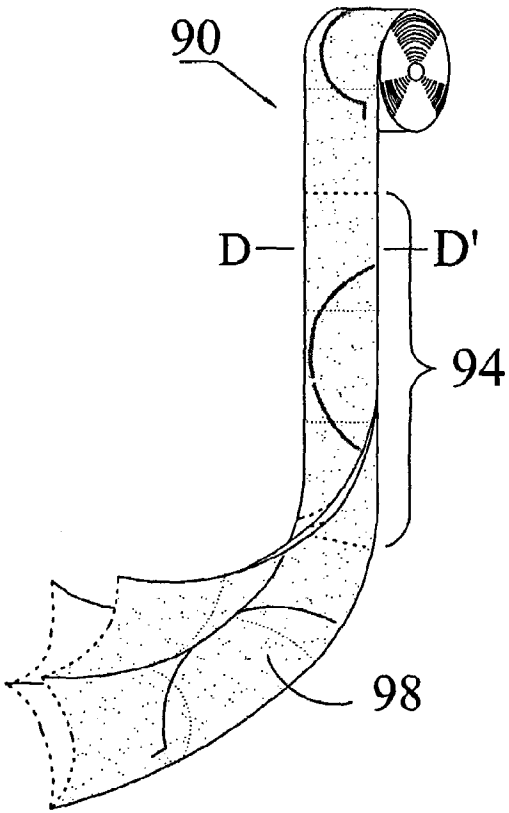
FIG. 21 is perspective view of an alternate sanitary paper strip, according to some embodiments of the present invention, folded so that the two laterally-folded, longitudinal layers of the sanitary paper strip are adjacent and touching.

FIGS. 21 through 23C show another embodiment of a sanitary paper strip according to the present invention, similar to the embodiment of sanitary paper strip 70 shown in FIGS. 17 and 18. In the present embodiment, a sanitary paper strip 90 has a precut bowl flap 98, shown in FIG. 21. The main difference between sanitary paper strip 70 of FIG. 17 and sanitary paper strip 90 of FIG. 21 is related to the manner of folding the sanitary paper strips. FIG. 22 is a magnified cross-sectional view taken along the D-D' line of FIG. 21. The folding of sanitary paper strip 90 is such that two, folded, outer layers 93*a* and 93*b* (which comprise the two laterally-folded, longitudinal layers of sanitary paper strip 90) are adjacent and closely overlap each other. This is in contrast to the folded sanitary paper strip 70 shown in FIG. 17.

Figure 23C:
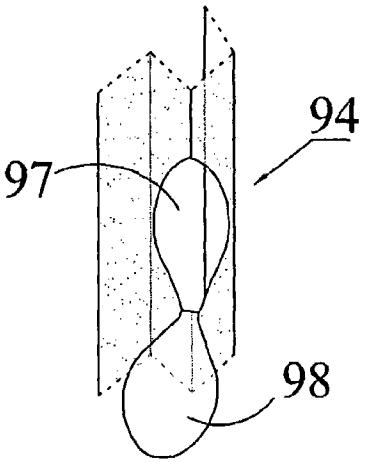
FIG. 23C is a perspective view of a partially-unfolded seat-cover detached from a sanitary paper strip, shown in FIG. 21, after the precut bowl flap has been fully-released, according to some embodiments of the present invention.
Figure 23B:
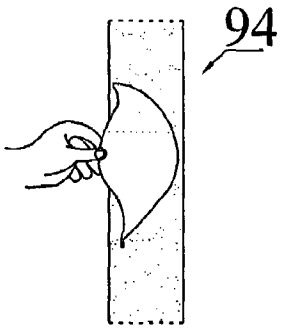
FIG. 23B is a perspective view of a fully-folded seat-cover detached from a sanitary paper strip, shown in FIG. 21, after the precut bowl flap has been partially-released, according to some embodiments of the present invention.
Figure 23A:
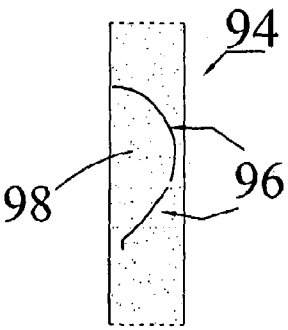
FIG. 23A is a plan view of a fully-folded seat-cover detached from a sanitary paper strip, shown in FIG. 21, according to some embodiments of the present invention.

FIG. 23A shows a fully-folded seat-cover 94 detached from sanitary paper strip 90. Seat-cover 94 has appropriate niches 96 cut into it for releasing bowl flap 98. FIG. 23B shows seat-cover 94 detached from a sanitary paper strip 90 after bowl flap 98 has been partially-released. FIG. 23C shows seat-cover 94 partially-unfolded after bowl flap 98 has been fully-released, exposing centrally-located opening 97. The description and use of sanitary paper strip 90 is otherwise similar to sanitary paper strip 10 detailed above.

FIGS. 24 through 27 show another embodiment of a sanitary paper strip according to the present invention, similar to the embodiment of sanitary paper strip 10 shown in FIGS. 1 through 10. The main difference between sanitary paper strip 10 of FIG. 1 and a sanitary paper strip 100 of FIG. 24 is related to the folding configuration of the sanitary paper strips. In contrast to sanitary paper strip 10 shown in FIG. 1, where sanitary paper strip 10 is folded to produce four layers, sanitary paper strip 100 of the present embodiment shown in FIG. 24 is folded in three layers. The folding configuration of sanitary paper strip 100 is shown more clearly in FIG. 25, which is a cross-sectional view of sanitary paper strip 100 taken along the E-E' line of FIG. 23.

Another difference between sanitary paper strip 10 of FIG. 1 and sanitary paper strip 100 of FIG. 24 is related to the material composition of the sanitary paper strips. While sanitary paper strip 10 (FIG. 1) is made of a duplex paper with smooth seat-cover side 14 and rough tissue-paper side 16, sanitary paper strip 100 (FIG. 24) is made of material that is commercially used for manufacturing tissue paper, where both sides are relatively rough. In addition, sanitary paper strip 100 (FIG. 24) has seat-cover perforation lines 102, that define the beginning and the end of seat-cover 104, where seat-cover perforation line 102 each is a combination of straight lines, in contrast to the curved, seat-cover perforation lines 22 of sanitary paper strip 10 (shown in FIG. 1).

As shown in FIG. 25, sanitary paper strip 100 is folded in such way that it produces three layers that resembles a three-ply tissue paper. FIG. 26 is a perspective view of sanitary paper strip 100 partially-unfolded, where the configuration of sanitary paper strip 100 resembles the English letter "Z". In the present embodiment shown in FIGS. 24 and 26, a precut bowl flap 108 of a seat-cover 104 is located in the middle layer (FIG. 24), between two laterally-folded, longitudinal layers 103*a* and 103*b* (FIG. 25). FIG. 27 shows a fully-unfolded seat-cover 104 detached from sanitary paper strip 100. The description and use of sanitary paper strip 100 is otherwise similar to sanitary paper strip 10 detailed above.

As was mentioned above, the use of multi-ply duplex paper would result in multi-ply layers. Thus, for example, included in our definition of duplex paper, in the "Z" configuration described above, are a two-ply duplex paper which would have three layers where each of these layers is a two-ply layer, a three-ply duplex paper which would have three layers where each of these layers is a three-ply layer, and other similar configurations.

FIGS. 28 through 31 show another embodiment of a sanitary paper strip according to the present invention, similar to the embodiment of sanitary paper strip 100 shown in FIGS. 24 through 27. As shown in FIGS. 28 and 29, a sanitary paper strip 110 is made of a paper where both sides 116 are rough (shown in FIG. 29), and folded to produce three layers. However, the main difference between sanitary paper strip 100 of FIG. 24 and sanitary paper strip 110 of FIG. 28 is related to the folding configuration of the sanitary paper strips. FIG. 29 is a cross-sectional view of sanitary paper strip 110 taken along the F-F' line of FIG. 28. In contrast to the "Z"-folding configuration of sanitary paper strip 100 shown in FIG. 24, sanitary paper strip 110, shown in FIGS. 28 and 29, is folded in such a configuration that two laterally-folded longitudinal layers 119*a* and 119*b* are lapped on top of each other, and are vertically-adjacent when sanitary paper strip 110 is fully-folded.

Furthermore, in contrast to sanitary paper strip 100 of FIG. 24, where bowl flap 108 is not in an exposed outer layer when sanitary paper strip 100 is fully-folded, sanitary paper strip 110 (shown in FIGS. 28, 30, and 31) has a precut bowl flap 118 of a seat-cover 114 located in an exposed outer layer of sanitary paper strip 110. The unfolding of seat-cover 114 detached from sanitary paper strip 110 is facilitated by bowl flap 118, in a similar way to the embodiment shown in FIGS. 23A through 23C for unfolding seat-cover 94. The description and use of sanitary paper strip 110 is otherwise similar to sanitary paper strip 10 detailed above.

Figure 32:
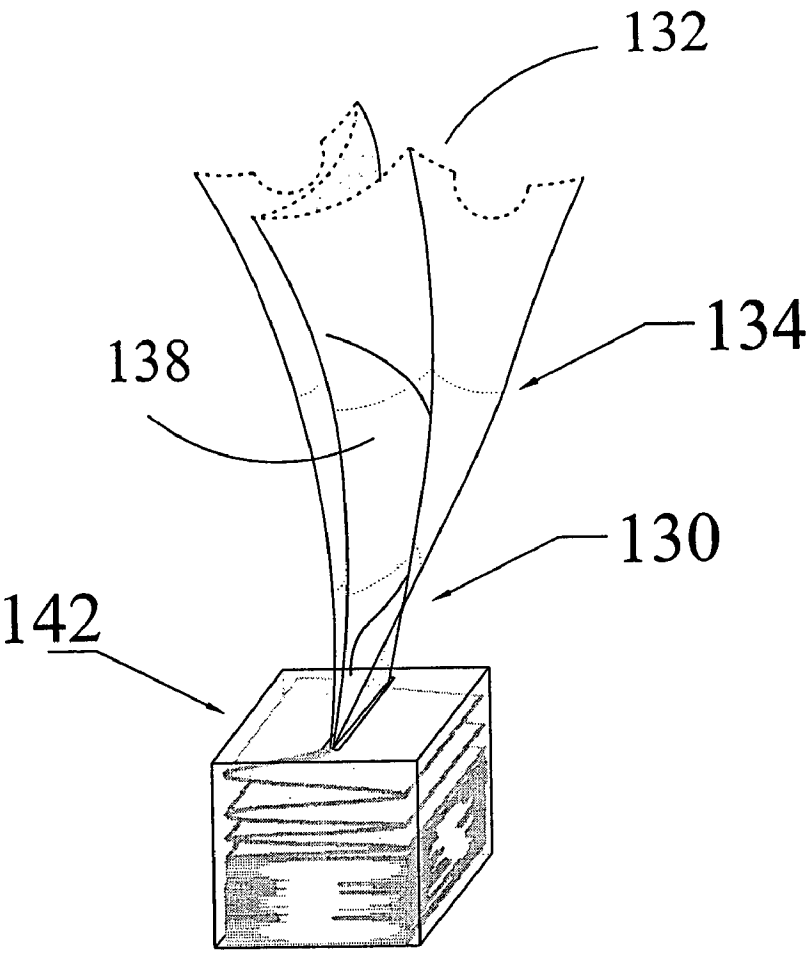
FIG. 32 is a perspective view of a folded, sanitary paper strip, shown in FIGS. 3 and 4, stacked in a box, according to some embodiments of the present invention.

FIG. 32 shows another embodiment of a sanitary paper strip according to the present invention, similar to the embodiment of sanitary paper strip 10 shown in FIG. 1. The main difference between sanitary paper strip 10 of FIG. 1 and a sanitary paper strip 130 of FIG. 32 is related to the packaging. While folded sanitary paper strip 10 is packaged in a roll in the embodiment shown in FIG. 1, folded sanitary paper strip 130 is stacked in a box 142 in the present embodiment shown in FIG. 32. Sanitary paper strip 130 contains a precut bowl flap 138 of a detachable seat-cover 134. Sanitary paper strip 130 also has curved, seat-cover perforation lines 132 that define the transverse edge of detachable seat-cover 134. The description and use of sanitary paper strip 130 is otherwise similar to sanitary paper strip 10 detailed above.

Although the preferred sanitary paper is of a duplex-type paper according to the preferred embodiment, papers that are rough on both sides can be appropriately used as well. Almost any type of disposable and flushable paper, like those that are commonly used in commercial tissue paper, is appropriate to be used in the present invention, including paper that is impregnated with detergents or antibacterial compounds.

While the invention has been described with respect to a limited number of embodiments, it will be appreciated that many variations, modifications, and other applications of the invention may be made. Although the invention has been described in terms of specific embodiments and applications, those skilled in the art can, in light of this teaching, generate additional embodiments without exceeding the scope or departing from the spirit of the claimed invention. Accordingly, it is to be understood that the drawings and descriptions in the present disclosure are meant to facilitate comprehension of the invention, and should not be construed to limit the scope thereof. Furthermore, it will be appreciated that the proportional dimensions of the drawings have been greatly exaggerated for the purpose of clarity. In addition, phraseology and terminology employed herein are for the purpose of description and should not be regarded as limiting.

What is claimed is:

1. A device that is appropriate to be used as tissue paper and as toilet seat-covers, the device comprising:

(a) a sanitary paper strip for cleaning or wiping by a user and covering a toilet seat, said sanitary paper strip having a plurality of detachable sections of tissue paper, where at least some of said detachable sections are folded, unitary toilet seat-covers, said sanitary paper strip layered to produce at least three layers; and (b) a plurality of transverse continuous perforation lines that define said plurality of detachable sections of tissue paper, wherein at least some of said plurality of transverse perforation lines are seat-cover perforation lines, said seat cover perforation lines define a beginning and an end of an individual seat-cover, wherein each of said individual seat-cover has a precut centrally-located bowl flap, and wherein at least one of said individual seat covers is crossed by across the width of the seat cover and in least one of said transverse perforation lines at said precut centrally-located bowl flap thereof.

2. The device of claim 1, wherein said individual seat-cover, when fully-unfolded and applied appropriately on said toilet seat, has a configuration and size sufficient to cover said toilet seat, such that said individual seat-cover prevents direct contact between said toilet seat and the skin of said user.

3. The device of claim 1, wherein each of said individual seat-cover has a centrally-located bowl cutout, said bowl cutout of said individual seat-cover is smaller than the opening of said toilet seat.

4. The device of claim 3, wherein said bowl cutout of said individual seat-cover has at least one rim flap, said at least one rim flap for facilitating proper positioning of said individual seat-cover on said toilet seat.

5. The device of claim 3, wherein said sanitary paper strip is layered to produce three consecutively-stacked layers with a cross-sectional outline resembling an English letter "Z" when said sanitary paper strip is partially-unfolded.

6. The device of claim 1, wherein said detachable sections of tissue paper serve at least two functions, appropriate for cleaning or wiping by said user, and appropriate for covering said toilet seat when fully-unfolded.

7. The device of claim 1, wherein at least some of said transverse seat-cover perforation lines are straight.

8. The device of claim 1, wherein at least some of said transverse seat-cover perforation lines are non-linear.

9. The device of claim 1, wherein at least some of said seat-cover perforation lines are oriented in each said at least three layers of said sanitary paper strip to form at least one non-overlapping handle member upon detaching said individual seat-cover, said at least one non-overlapping handle member for facilitating unfolding of said individual seat-cover by said user.

10. The device of claim 1, wherein at least one of said at least three layers has a width that forms a non-overlapping adjacent layer, said non-overlapping adjacent layer for facilitating unfolding of said individual seat-cover by said user.

11. The device of claim 1, wherein said individual seat-cover has at least one niche located at an exposed outer layer of said at least three layers, said at least one niche exposing a part of an adjacent layer of said at least three layers to said exposed outer layer, said at least one niche having a location and size for facilitating unfolding of said individual seat-cover by said user holding said exposed part of said adjacent layer.

12. The device of claim 1, wherein said sanitary paper strip is made of a soft, disposable, flushable, and highly-absorbent material.

13. The device of claim 1, wherein said sanitary paper strip is wrapped in a substantially roll configuration.

14. The device of claim 13, wherein said sanitary paper strip is rolled such that said centrally-located bowl flap of said sanitary paper strip is located on an unexposed surface of said substantially roll configuration.

15. The device of claim 1, wherein said sanitary paper strip is stack-folded in a pop-up dispenser.

16. The device of claim 1, wherein said sanitary paper strip is stack-folded in a box.

17. The device of claim 1, wherein said sanitary paper strip is impregnated with a chemical on at least one surface.

18. The device of claim 1, wherein said sanitary paper strip is composed of a plurality of plies, at least one layer of said at least three layers is composed of said plurality of plies.

19. The device of claim 1, wherein said sanitary paper strip is layered to produce three layers, two laterally-folded longitudinal layers of said three layers are lapped on top of each other, and are vertically-adjacent when said sanitary paper strip is fully-folded, said centrally-located bowl flap is located in an external layer of said three layers.

20. The device of claim 1, wherein at least a part of said centrally-located bowl flap of said individual seat-cover of said sanitary paper strip is located in an inner layer of said at least three layers when folded.

21. The device of claim 1, wherein at least a part of said centrally-located bowl flap of said individual seat-cover of said sanitary paper strip is not exposed to direct contact with said user.

22. The device of claim 1, wherein said sanitary paper strip is layered longitudinally to produce three consecutively-stacked layers with a cross-sectional outline resembling an English letter "Z" when said sanitary paper strip is partially-unfolded.

23. The device of claim 1, wherein said sanitary strip is layered longitudinally to produce four layers.

24. The device of claim 23, wherein said four layers are longitudinal and have a cross-sectional outline resembling an English letter "W" when said sanitary paper strip is partially-unfolded, said centrally-located bowl flap is located in two inner layers of said four layers.

25. The device of claim 23, wherein said four layers have two laterally-folded longitudinal layers of said sanitary paper strip adjacent to each other and located on one side of said sanitary paper strip.

26. The device of claim 1, wherein said sanitary paper strip is layered longitudinally to produce four layers with a cross-sectional outline resembling an English letter "W" when said sanitary paper strip is partially-unfolded, said centrally-located bowl flap is located in two inner layers of said four layers.

27. A device that is appropriate to be used as a tissue paper and as a toilet seat-cover, the device comprising:

(a) a sanitary paper sheet, layered to produce at least three layers, for cleaning or wiping by a user and for covering a toilet seat, said sanitary paper sheet having an individual, folded, unitary toilet seat-cover integral to said sanitary paper sheet, wherein said seat-cover has a precut centrally-located bowl flap; and (b) at least one transverse continuous perforation line, in said sanitary paper sheet, for defining detachable sections of tissue paper for cleaning or wiping by a user, wherein at least one of said at least one transverse perforation lines crosses said toilet seat cover across the width of the seat cover and in said precut centrally-located bowl flap.

28. The device of claim 27, wherein at least two said sanitary paper sheets are stack-folded together in a container.

29. The device of claim 27, wherein at least two said sanitary paper sheets are stack-folded in a dispenser in such way that upon removal of an initial said sanitary paper sheet, a subsequent said sanitary paper sheet becomes exposed through an opening of said dispenser, thereby allowing said subsequent sanitary paper sheet to be removed.

30. The device of claim 27, wherein said seat-cover, when fully-unfolded and applied appropriately on a toilet seat, has a configuration and size sufficient to cover said toilet seat, such that said seat-cover prevents direct contact between said toilet seat and the skin of said user.

31. The device of claim 27, wherein at least one of said at least three layers has a width that forms a non-overlapping adjacent layer, said non-overlapping adjacent layer for facilitating unfolding of said seat-cover by said user.

32. The device of claim 27, wherein said seat-cover has at least one niche located at an exposed outer layer of said at least three layers, said at least one niche exposing a part of an adjacent layer of said at least three layers to said exposed outer layer, said at least one niche having a location and size for facilitating unfolding of said seat-cover by said user holding said exposed part of said adjacent layer.

33. The device of claim 27, wherein said sanitary paper sheet is composed of a plurality of plies, at least one layer of said at least three layers is composed of said plurality of plies.

34. The device of claim 27, wherein said sanitary paper sheet is layered to produce three layers, two laterally-folded longitudinal layers of said three layers are lapped on top of each other, and are vertically-adjacent when said sanitary paper sheet is fully-folded, said centrally-located bowl flap is located in an external layer of said three layers.

35. The device of claim 34, wherein at least a part of said centrally-located bowl flap of said seat-cover of said sanitary paper sheet is located in an inner layer of said at least three layers when folded.

36. The device of claim 34, wherein at least a part of said centrally-located bowl flap of said seat-cover of said sanitary paper sheet is not exposed to direct contact with said user.

37. The device of claim 27, wherein said sanitary paper sheet is layered longitudinally to produce three consecutively-stacked layers with a cross-sectional outline resembling an English letter "Z" when said sanitary paper sheet is partially-unfolded.

38. The device of claim 27, wherein said sanitary paper sheet is layered longitudinally to produce four layers.

39. The device of claim 38, wherein said four layers are longitudinal and have a cross-sectional outline resembling an English letter "W" when said sanitary paper sheet is partially-unfolded, said centrally-located bowl flap is located in two inner layers of said four layers.

40. The device of claim 38, wherein said four layers have two laterally-folded longitudinal layers of said sanitary paper sheet adjacent to each other and located on one side of said sanitary paper sheet.

41. The device of claim 27, wherein said seat-cover has a centrally-located bowl cutout, said bowl cutout of said seat-cover is smaller than the opening of a toilet seat.

42. The device of claim 41, wherein said bowl cutout of said seat-cover has at least one rim flap, said at least one rim flap for facilitating proper positioning of said seat-cover on said toilet seat.

43. The device of claim 41, wherein said sanitary paper sheet is layered to produce three consecutively-stacked layers with a cross-sectional outline resembling an English letter "Z" when said sanitary paper sheet is partially-unfolded.

44. The device of claim 41, wherein said sanitary paper sheet is layered to produce four layers with a cross-sectional outline resembling an English letter "W" when said sanitary paper sheet is partially-unfolded, said centrally-located bowl cutout is located in two inner layers of said four layers.

45. The device of claim 27, wherein said sanitary paper sheet is impregnated with a chemical on at least one surface.

* * * * *